US005300985A

United States Patent [19]

Demott et al.

[11] Patent Number: 5,300,985

[45] Date of Patent: Apr. 5, 1994

[54] MULTI-FUNCTION ERASE LAMP

[75] Inventors: John C. Demott, Rochester; Charles J. Urso, Jr., Webster; Mary A. Straube, Penfield; Donald E. Wiedrich, Ontario; Robert W. Corbin, Fairport, all of N.Y.

[73] Assignee: Xerox Corporation, Stamford, Conn.

[21] Appl. No.: 891,326

[22] Filed: May 29, 1992

[51] Int. Cl.[5] ..... G03G 21/00

[52] U.S. Cl. ..... 355/218; 355/71

[58] Field of Search ..... 355/218, 229, 67, 70, 355/71; 362/217, 263, 260, 321

[56] References Cited

U.S. PATENT DOCUMENTS

| | | | |
|---|---|---|---|
| 4,129,378 | 12/1978 | Rattin et al. | 355/218 |
| 4,133,609 | 1/1979 | Arai | 355/218 |
| 4,576,464 | 3/1986 | Sakata et al. | 355/218 |
| 4,806,975 | 2/1989 | Godlove et al. | 355/218 |
| 4,839,696 | 6/1989 | Ohtani | 355/218 |
| 4,843,427 | 6/1989 | Ibuchi | 355/218 |
| 4,876,570 | 10/1989 | Iwaya | 355/218 X |

*Primary Examiner*—A. T. Grimley
*Assistant Examiner*—Nestor R. Ramirez

[57] ABSTRACT

A multi-function, multi-segment ac plasma erase lamp is provided to selectively erase previously charged areas of a photoconductive member. The lamp performs the conventional erase function of fixed edge erase, edge shift and patch generation, while adding the functions of variable edge erase along an edge to accommodate reduction images and changes in page size. Another feature of this erase lamp is a "dark" segment which is energized but is not light emitting. Its function is to enhance the turn on time for the light emitting segments. A still further improvement is the application of a voltage to a photoresist coating applied the the lamp surface to create a field which will repel toner and dust particles from that surface of the lamp.

2 Claims, 5 Drawing Sheets

MULTI-FUNCTION ERASE LAMP

BACKGROUND OF THE INVENTION

This invention relates to an electrophotographic printing machine and more particularly to a multifunction erase lamp system which incorporates addressable segments for accomplishing interdocument and edge erase functions, vertical image shifts and improved turn on response.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational area contained within the original document. After the electrostatic latent image is recorded on the photoconductive member, the latent image is developed by bringing a developer material into contact therewith.

In this process, certain areas of the photoconductive member are charged and not used for imaging. These charged, unused areas are subsequently developed with toner particles. Inasmuch as these toner particles are not transferred to the copy sheet, they must be cleaned from the photoconductive member prior to the next successive imaging cycle or they will degrade the copy. Alternatively, if these non-image regions are not charged, or if they are discharged before development, the non-image areas of the photoconductive member will not be developed with toner particles and there is no requirement to clean the photoconductive member. The non-image areas on the photoconductive member requiring discharge are the interdocument area and the edge areas. The interdocument areas are the non-image areas before the first electrostatic latent image, between adjacent latent images, and after the last latent image of a series of latent images recorded on the photoconductive member. The edge areas are the non-image areas adjacent the sides of the latent image recorded on the photoconductive member. If the original document is edge registered, then one edge of the latent image will always be aligned with one edge of the photoconductive member, and only one side need be erased. When the electrophotographic printing machine is capable of varying the magnification of the copy, the size of the non-image areas change. For example, if a reduced size image is made, the interdocument area and one or both of the edge areas increase in size.

In order to erase the charged interdocument area, erase lamps extending across the photoconductive member perpendicular to the path of movement are energized for a selected time period as a function of the velocity of the photoconductive member so as to illuminate the entire interdocument area. The selected time of energization varies as a function of the size of the interdocument area. Edge erase requires that the length of the erase light be adjusted to compensate for different size images.

Various prior art charge erase devices are known and an extensive listing of references is identified and summarized in U.S. Pat. No. 4,806,975 (Godlove et al.), whose contents are hereby incorporated by reference. The Godlove patent discloses a multifunction plasma-erase lamp which incorporates a segmented electrode, each segment being selectively energized and associated with a specific erase function (interdocument, edge erase, formation of a test patch area). With the ever demanding customer requirement for improved copy quality and extended product life, it has become necessary to provide lamps with significantly improved light output stability, optimized spectral output and improved life characteristics. It has also become increasingly more important to utilize lamps capable of providing narrow exposure profiles necessitating narrow emitting areas and fast response times.

SUMMARY OF THE INVENTION

The present invention is, therefore, directed to an improved AC plasma neon lamp which combines the functions previously known in the art with additional functions such as variable edge erase and reduced turn on response time. More particularly, the present invention relates to a lamp system for erasing selected areas of an electrically charged photoconductive member including:

a plasma neon lamp including a continuous electrode and a segmented electrode with a gaseous medium interposed therebetween said segmented electrode having a plurality of light emission segments, a first segment positioned at one end of the lamp for discharging one edge of the charged area of the photoconductive member, and at least a second segment positioned at the other end of the lamp for discharging the opposite edge of the charged area of the photoconductive member, means for selectively energizing said light emission segments so as to selectively illuminate or discharge the charged areas of the photoconductive member, and a movable shutter member for selectively blocking light emission from said second segment so as to vary the amount of charged area illuminated by said second segment.

DESCRIPTION OF THE INVENTION

Figure 1:
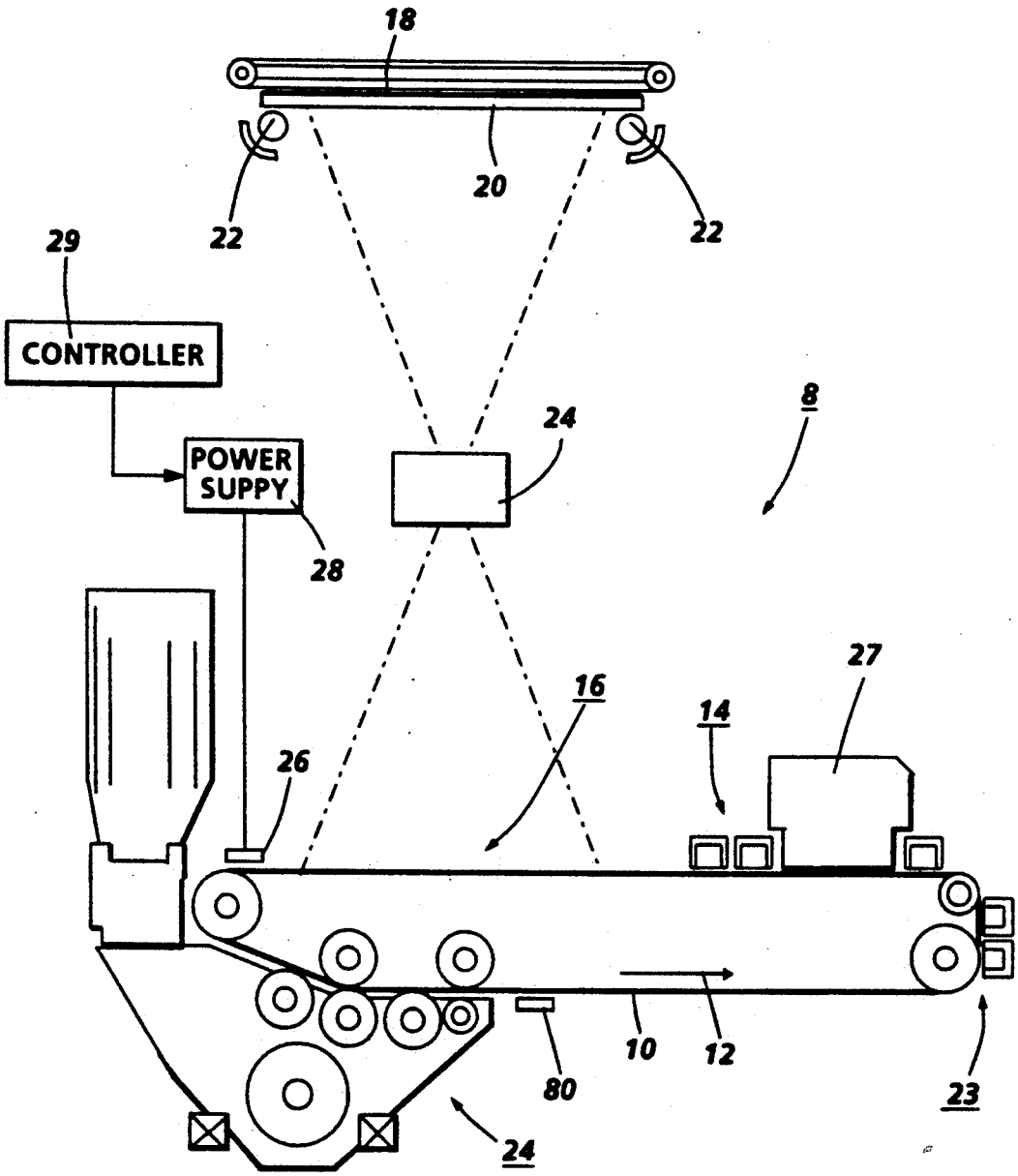
FIG. 1 is a schematic plan view showing the operation of the erase lamp of the present invention, used in a printing environment.

FIG. 1 shows a portion of an electrophotographic printing machine 8, of the type disclosed in U.S. Pat. No. 4,806,975, but incorporating the erase lamp of the present invention. A photoreceptor belt 10 is driven in the direction of arrow 12, passing beneath a charging station 14, where the belt is charged to relatively high, substantially uniform potential. Following the charging step, the belt advances through exposure zone 16. A document 18 is placed on platen 20, either manually or by means of a document handler, and is flash exposed by flash lamps 22 mounted in an optical cavity (not shown). Lens 24 focuses light images of the original document onto the charged portions of the photoreceptor surface of belt 10, to selectively discharge the charge thereon. This records an electrostatic latent image on the photoreceptor which corresponds to the informational areas of document 18. Thereafter, belt 10 advances past erase lamp 26 of the present invention which is selectively energized from power supply 28, under control of system controller 29, to discharge the charge in selected non-images regions as described in more detail below. The belt then advances through development station 24, where the latent image is developed and subsequently transferred to an output sheet at transfer station 23. The transferred image is selectively fused at a fusing station (not shown) and the belt surface cleaned at a cleaning station 27, which is between the transfer and charging station.

Figure 2:
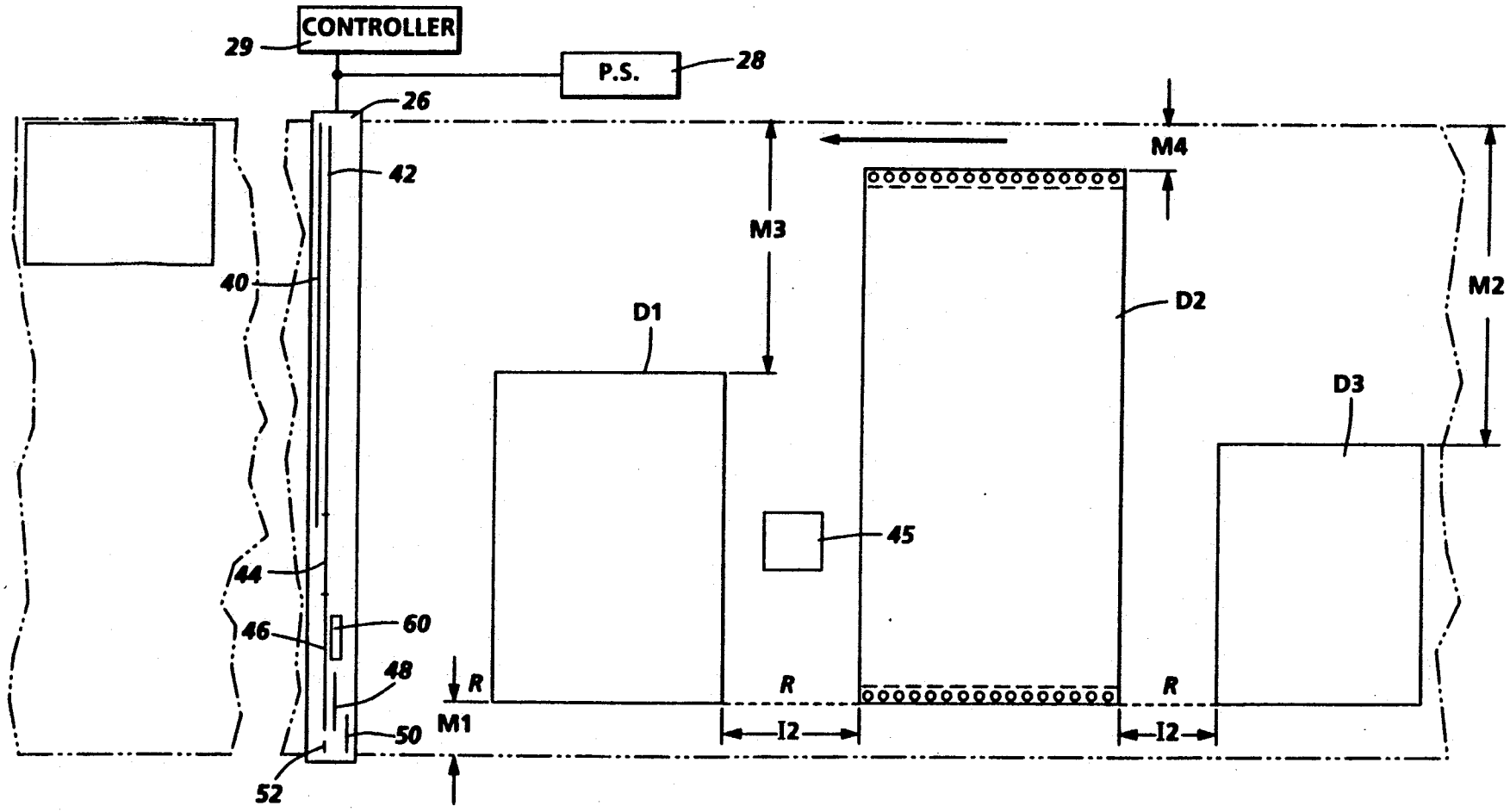
FIG. 2 is a top view of the photoreceptor belt of FIG. 1 and of the erase lamp with examples of the erase function accomplished with various image sizes.
Figure 3:
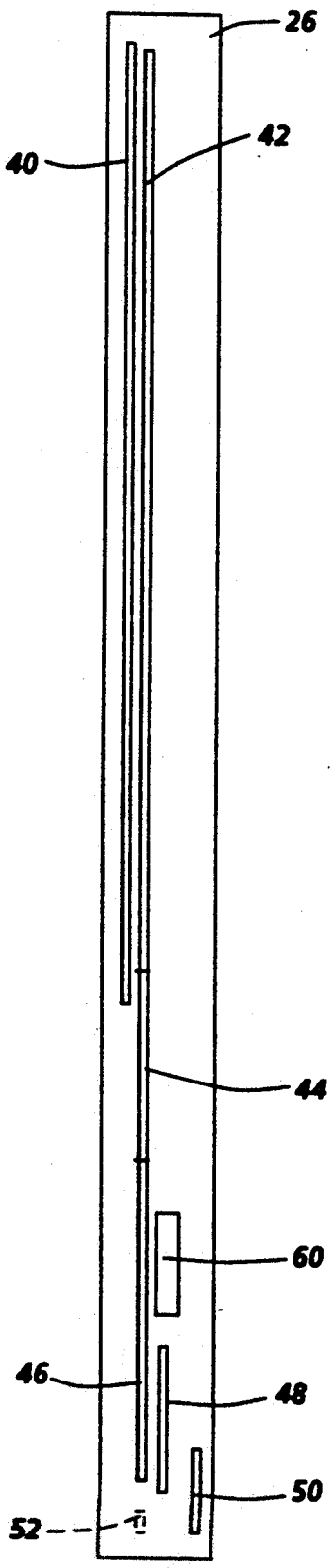
FIG. 3 is an enlarged top view of the erase lamp of FIG. 2.
Figure 4A:
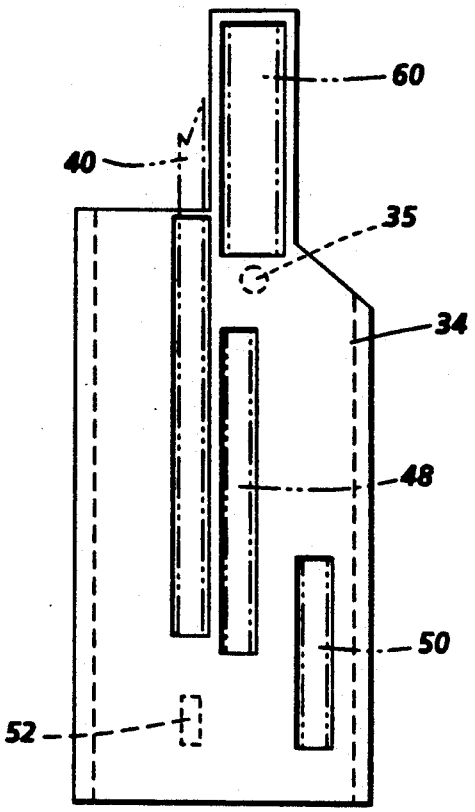
FIGS. 4*a*, 4B, 4C show three views of an adjustable shield member which selectively masks the light emission from selected light segments.
Figure 4B:
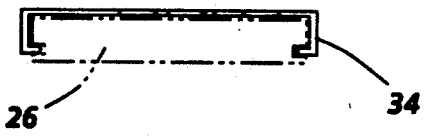
Figure 4C:
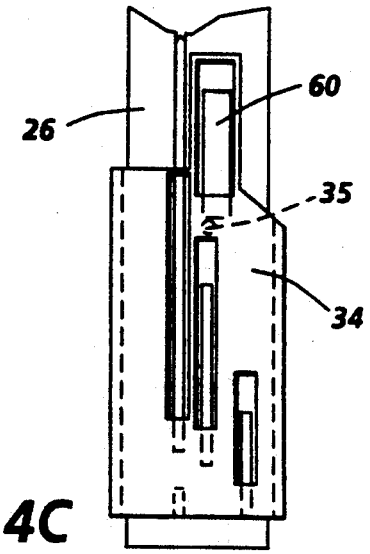

Referring now to FIGS. 2, 3 and 4, the general operation of erase lamp 26 will be described. FIG. 2 shows a lamp 26, which, for descriptive purposes, is shown rotated 180° from its normal position during operation (e.g. where the light emission segments face the photoreceptor surface). Also for purposes of description, three document image frames, D1, D2 and D3 are shown as being previously exposed, each requiring a different combination of edge and interdocument frame erases. D1 is an image frame for a conventional sized document; D2 is for a computer fan form document and D3 is for a reduced document. Lamp 26 is a multi-segment, plasma neon light source, the light source constructed generally as set forth in the Godlove patent, referenced supra. The lamp has a transparent housing defining a chamber filled with a gaseous medium (neon in the preferred embodiment), with a pair of spaced electrodes comprising a continuous electrode and a segmented electrode spaced from the continuous electrode by at least a portion of the gaseous medium. This segmented electrode comprises seven distinct segments as follows: a bottom edge fade out segment 40, a bottom interdocument segment 42, a patch generator segment 44, a top interdocument segment 46, a vertical image shift segment 48, a top edge fadeout segment 50, and a dark start segment 52. These segments are shown with exaggerated width for ease of description in FIG. 3. In reality, they have the fine line configuration shown in FIG. 2.

Figure 6:
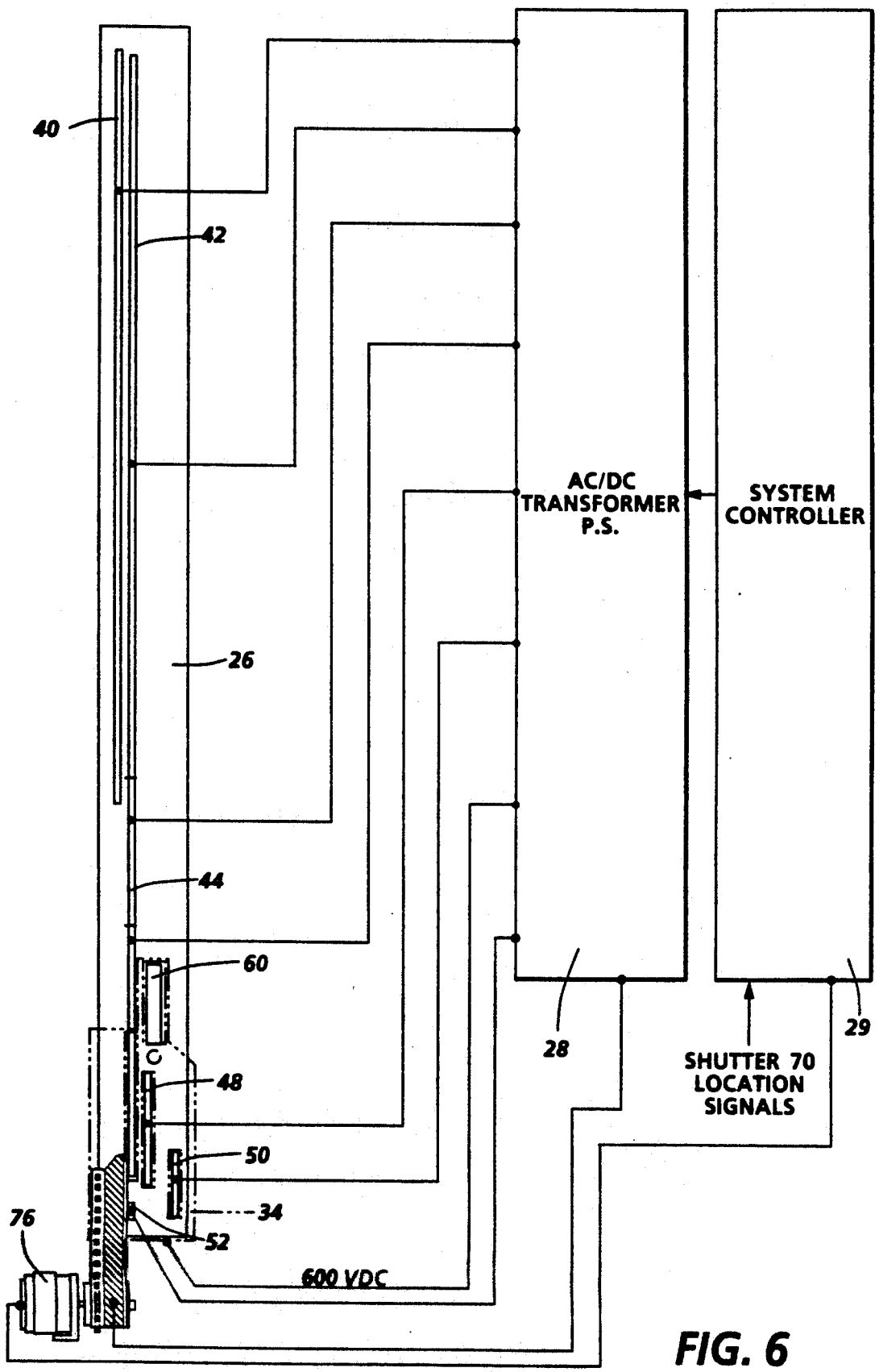
FIG. 6 is a drive control circuit for the light emitting segments of the erase lamp.

Continuing with a further description of the erase lamp, the surface of the lamp (FIG. 3) is coated with a weakly conductive black photoresistant material. A highly conductive metal strip 60 is formed on the surface of the lamp in electrical contact with the photoresist. At the top end of the lamp, shield 34 (FIGS. 4A, 4B, 4C) is slidely mounted so as to be movable vertically along the top end of the lamp. Shield 34 has apertures therethrough which uncover the face of segments 48 and 50 but allow for selective covering of these segments to set an initial light emission segment. Shield 34 also serves a second toner repelling function in cooperation with strip 60 and the photoresist applied to the surface of lamp 26. A problem with prior art erase lamps is the tendency for toner, which escapes from the developer housing or is dislodged from a developed location on the surface of the belt to be attracted to the surface of the erase lamp and to interfere with the light output of the light emission segment. The shield 34 has a slightly protruding dimple 35, which makes firm contact with strip 60, via shield 34. Upon application of a suitable bias voltage to strip 60 (approximately 600 volts as shown in FIG. 6), a current flows through the electrical contact of strip 60 and into the photoresist creating a slightly negative polarity at the coated surface of the lamp which repels the positively charged toner particles.

The segments perform the following functions, each of which are described in further detail below: top and bottom edge erase; cycle up-cycle down erase; interdocument erase; erase during a skipped pitch; patch generation and instant turn on. The lamp is connected to a power supply 28 which, under control of system controller 29, supplies power to each of the segments as described in further detail below. Controller 29 regulates the various machine functions. The controller is preferably a programmable microprocessor, which controls the machine functions hereinbefore described.

TOP EDGE ERASE

Referring to FIGS. 2 and 3, the top edge erase segment 50 and variable bottom edge erase segment 40 define the top and bottom edges of the copy image by discharging the outboard and inboard areas, respectively, of the photoreceptor that are outside the image. Since the machine is outboard registered (all images are bottom registered along line R—R), the top edge of the image is laid down in the same location (except for vertical shift operation). Hence, the top edge erase distance M1 is set initially by movement of shield 34, as shown in FIG. 4, and the same edge area is always erased.

BOTTOM EDGE (VARIABLE) ERASE

Figure 5:
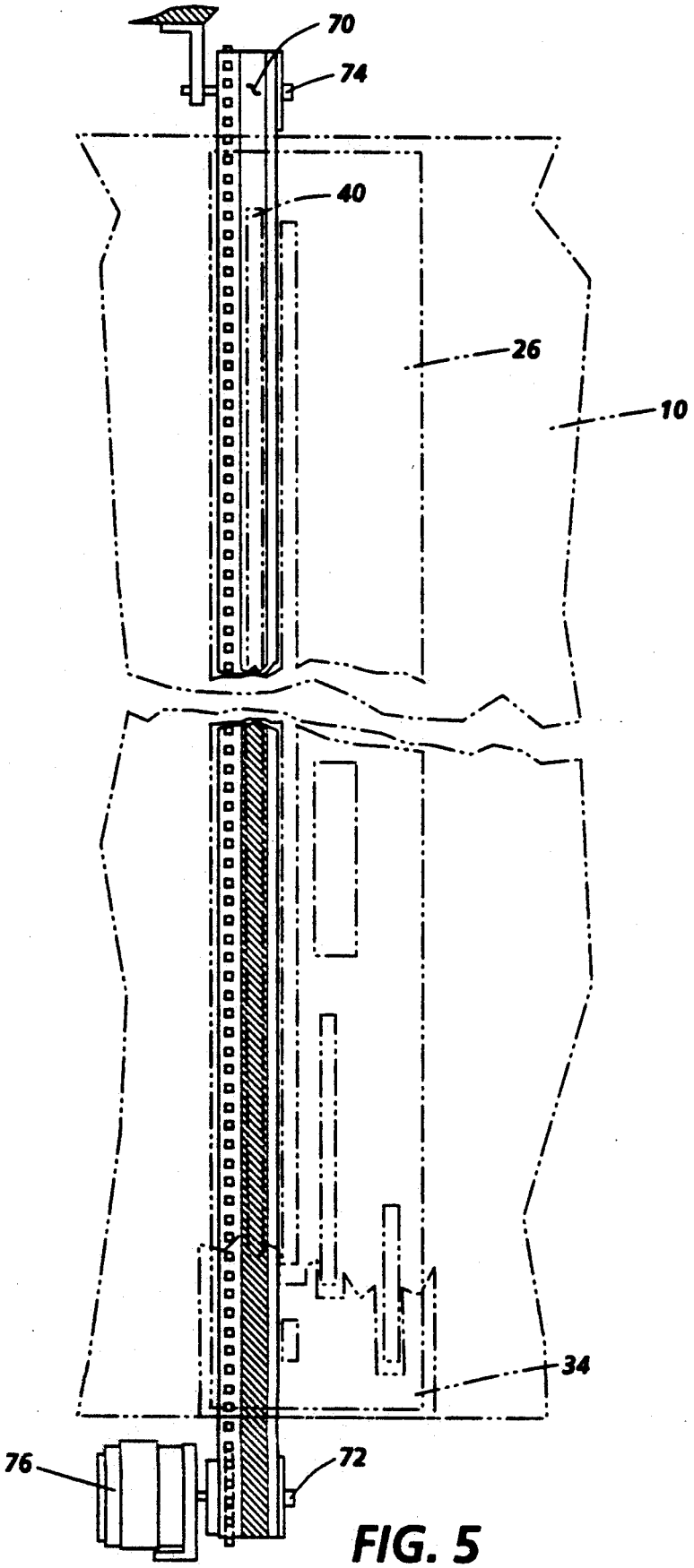
FIG. 5 shows an enlarged view of the endless film mask which enables a variable edge erase function.

The bottom edge of an image can fall at varying positions depending upon factors such as image magnification (frame D3 is formed); image shift, whether a computer fanfold document image is to be formed (frame D2). According to one of the features of the present erase lamp, segment 40 output is automatically adjustable on a job by job basis in conjunction with operation of an endless film shutter 70. Shutter 70, shown in FIG. 5, is a partially transparent, partially opaque sprocketed endless Mylar TM strip which is entrained over a drive roller 72 and an idler roller 74. The sprockets mate with sprockets on the output shaft of stepper motor 76. The stepper motor is under the control of system controller 29 and is driven in response to signals from the paper tray selected for the copying operation, as well as magnification for the copying operation. The purpose of shutter 70 is to selectively block the light output of bottom segment 40 to allow for more or less erasing of the bottom edge. The shutter is shown in FIG. 5 in a position which provides an erase margin corresponding to distance M3 in FIG. 2. Thus, in response to signals generated from the copy paper drawer and magnification switches selected by an operator, stepper motor 76 is activated to cause the shutter to rotate over the idler rollers to the position where the opaque portion masks out the lower portion of segment 40, but permits light output from the upper portion of segment 40 through a transparent portion of the film strip. The belt location is known by means of a sensor (not shown) located beneath the belt which senses the passage of the sprocket holes and sends a location signal to the controller. It is thus understood that, depending upon the position of shutter 70, more or less of segment 40 is covered thereby permitting a variable bottom edge erase function to be accomplished. The normal (home) position of shutter 70 is to permit maximum light output from segment 40; e.g. opaque strip is just past the top end of segment 40. Timing delays are built into the system to allow for movement of the shutter to a required position consistent with a change in output paper size or magnification.

INTERDOCUMENT ERASE

When the lead edge of an image frame reaches the erase lamp, segments 42, 44 and 46 are turned off. After a delay, measured in machine clock pulses which correspond to the width of the image to be formed (measured by the width of the paper in the selected supply tray), segments 42, 44 and 46 are turned on to erase the change and minimize toner deposition in the interdocument area, shown as $l_2$ in FIG. 2. When the lead edge of the next image arrives, the segments will be turned off again.

SKIPPED PITCHES

In the case of a skipped pitch; e.g. an image is not formed in an image frame, segments 42, 44, 46 will turn on as an interdocument erase, but will stay on to erase the image frame which would normally contain a latent image. The segments will stay on until the leading edge of the next image arrives.

PATCH GENERATION

Patch generator segment 44 is energized by an initial high voltage which is used in conjunction with the interdocument erase function along with segments 42 and 46. Patch generator 44 also performs a patch generation function by producing an output at a lower intensity. Patch segment 44 is momentarily turned on to a normal high intensity level to accomplish full erase of approximately 2 mm to insure that the edge of the patch will not print out as a slightly misregistered copy. The voltage input is then reduced so that the segment intensity is lowered to some previously set initial test level. This lower intensity creates a toner patch 45 (FIG. 2) approximately 18 mm wide to be formed and later developed by developer 24. The reflectivity of this patch 45 is then measured by densitometer 80 (FIG. 1). At the end of the patch exposure period, the voltage is again increased to segment 44 to raise the intensity to completely erase another 2 mm strip. During the following belt revolution, the patch area 45 is erased at the high intensity level and the reflectivity of the now erased segment is again sensed by the densitometer to give an indication of the cleaning efficiency.

INSTANT TURN ON

Dark start segment 52 does not have a visible light output; it is turned on and left on as long as the machine power is on. This segment provides instantaneous ignition to the other lamp segments when they are addressed.

Turning now to FIG. 6, each segment of the lamp 26 is powered by an independent voltage supplied by power supply 28 under control of system controller 29. In a preferred embodiment, supply 28 is a single AC resonant power supply, typically 350 volts peak-to-peak and 323 kilohertz. The lamp segments are independently turned on and off by means of zero-crossing solid state switch circuits. The intensity of lamp segments is independently adjusted by voltage-controlled synchronous pulse-width-modulated switches, using a repetition rate adequate to avoid strobing effects on the photoconductive member. The power to each lamp segment could also be provided by the power supply circuits disclosed in U.S. Pat. No. 4,806,975.

While the invention has been described with reference to the structures disclosed, it is not confined to the details set forth, but is intended to cover such modifications or changes as they come within the scope of the following claims.

What is claimed is:

1. A lamp system for erasing selected areas of an electrically charged photoconductive member including:

a plasma neon lamp including a continuous electrode and a segmented electrode with a gaseous medium interposed therebetween said segmented electrode having a plurality of light emission segments, a first segment positioned at one end of the lamp for discharging one edge of the charged area of the photoconductive member, and at least a second segment positioned at the other end of the lamp for discharging the opposite edge of the charged area of the photoconductive member, means for selectively energizing said light emission segments so as to selectively illuminate or discharge the charged areas of the photoconductive member, and a movable shutter member for selectively blocking light emission from said second segment so as to vary the amount of charged area illuminated by said second segment, said movable shutter being a partially transparent, partially opaque strip which is rotated in an endless loop extending around the lamp in its length direction.

2. An electrophotographic printing machine of the type in which a light source is employed to discharge selected portions of a charge photoconductive member adapted to have successive electrostatic latent images of original documents being reproduced recorded thereon wherein the improved light source includes a lamp system for erasing selected portions of an electrically charged photoconductive surface, said lamp system including:

a plasma neon lamp including a continuous electrode and a segmented electrode with a gaseous medium interposed therebetween said segmented electrode having a plurality of light emission segments, means for selectively controlling light emission from said light emission segments so as to selectively illuminate or discharge the charged photoconductive areas associated with each segment, said light emitting segments including:

a first segment positioned at one end of the lamp for discharging one edge of the charged area of the photoconductive member, and at least a second segment positioned at the other end of the lamp for discharging the opposite edge of the charged area of the photoconductive member, and a movable shutter member for selectively blocking light emission from said second segment so as to vary the amount of charged area illuminated by said second segment, said movable shutter being a partially transparent, partially opaque strip which is rotated in an endless loop extending around the lamp in its length direction.

* * * * *